United States Patent [19]

Eckelt et al.

[11] Patent Number: 4,493,686

[45] Date of Patent: Jan. 15, 1985

[54] APPARATUS FOR PULLING TUBE ENDS OPEN TO FORM BASE SQUARES OF CROSS-BOTTOM SACKS

[75] Inventors: Ulrich Eckelt, Tecklenburg; Alois Winnemöller, Rheine, both of Fed. Rep. of Germany

[73] Assignee: Windmoller & Holscher, Lengerich, Fed. Rep. of Germany

[21] Appl. No.: 438,655

[22] Filed: Nov. 2, 1982

[30] Foreign Application Priority Data

Nov. 4, 1981 [DE] Fed. Rep. of Germany ..... 3143772

[51] Int. Cl.[3] ..... B31B 1/52

[52] U.S. Cl. ..... 493/256; 493/259

[58] Field of Search ..... 493/231, 253–259, 493/308; 53/378, 386, 384

[56] References Cited

U.S. PATENT DOCUMENTS 1,165,765 12/1915 Duvall ..... 493/256

3,250,187 5/1966 Kasting ..... 493/256 X 4,371,367 2/1983 Achelpohl et al. ..... 493/259 X

FOREIGN PATENT DOCUMENTS 2931607 6/1979 Fed. Rep. of Germany .

*Primary Examiner*—David Simmons

*Attorney, Agent, or Firm*—Fleit, Jacobson, Cohn & Price

[57] ABSTRACT

In apparatus for pulling tube ends open to form base squares in the production of large cross-bottom sacks, table plates are disposed parallel to the plane of the pulled open bases and separated from another by a gap through which a tubular web is feedable in a plane substantially perpendicular to the table plates. Suckers at both sides of the web pull the edges of the web end apart. The suckers are secured to carriages which are movable in parallel guides from a position in which they are pushed together to the pulled open position of the base.

16 Claims, 4 Drawing Figures

APPARATUS FOR PULLING TUBE ENDS OPEN TO FORM BASE SQUARES OF CROSS-BOTTOM SACKS

The invention relates to an apparatus for pulling tube ends open to form base squares in the production of large cross-bottom sacks, comprising table plates which are disposed in the machine frame parallel to the plane of the pulled-open bases and which are separated from one another by a gap through which the tubular web is feedable by feeding means in a plane substantially perpendicular to the table plates, and suckers disposed at both sides of the edges of the tubular web end for pulling the edges apart.

In an apparatus of this kind known from DE-OS No. 29 31 607, the suckers pull open an end of the web of tubular film that has a length corresponding to that required to form the base and that is folded onto one half of the table plate but they pull it open only until the upper edge can be engaged by a gripper which is secured to a pivotable yoke and which, for the purpose of pulling the base open, folds it onto the opposite half of the table plate whilst the other edge is likewise held by grippers. However, with this known apparatus, the base can be pulled open exactly only if the end zone of the tubular film folded onto the one table half has a fairly accurate length equal to that required to form the base, it being necessary to provide additional equipment for sweeping over the end zones of the edges of the pulled-open base.

It is the object of the present invention to provide an apparatus of the aforementioned kind with which, for the purpose of making large sacks, the ends of the tube can be pulled out whilst lying flat on the table plates and with the side edges being sharply defined.

According to the invention, this problem is solved in that the suckers are secured to carriages which are movable in parallel guides of the frame and which can be moved by drive means from their projected position to the pulled-open position of the base. In the apparatus according to the invention, the opposed central marginal zones of the tube ends are engaged by the suckers and pulled out parallel to the table plates until the base square has been formed on the table plates without any wrinkles but with accurate folded edges.

After the edges of the tube end have been suction-attracted, the suckers consisting of suction bars are desirably turned through 90° so that the suction-attracted end zones of the tube ends will also point in the pulling open direction.

Further, flaps are preferably provided in the carriages on shafts parallel to the gap, which flaps can be swung into the opened-up tube ends and carry at their free ends spreader plates which form pulling-out triangles and of which the outer edges include an angle of 90°. These flaps may be movable by drive means towards and away from one another parallel to the gap so that they may be adapted to bases of different sizes. It is also advantageous for each pair of flaps to be mounted as a unit displaceable transversely to the pulling-out direction so that inaccuracies in the end of the tube can be evened out and each base square is correctly pulled open in a flat condition corresponding to the shape of the tube end without being pulled out of shape.

In a further development of the invention, the operating units consisting of the suction bars and pivotable flaps are mounted by way of rollers for movement into the carriage in the pulling-out direction and are provided with drive means moving same relatively to the carriage. Before pulling out the base squares with the carriages, one can in this way well define the edges to be pulled out. Desirably, the suction bars in this case form counterbearings for the spreader plates for clamping the tube edges.

In a further development of the invention, the table plates are supported in their plane on guides by way of rollers and can be moved together and apart by drive means to clamp the tubular web.

In one embodiment of the invention, the guides of the carriages are pivotable by drive means about shafts parallel to the gap so that, in the pulled-out condition, the suction bars can be lowered with the spreader plates down to the plane of the table plates which are provided with complementary recesses. In this position, the pulled-open base lies smooth and flat on the table plates so that lowerable means can be employed to apply an inner lock to the pulled-open bases.

For the purpose of joining the inner lock to the pulled-open base, the table plate may be provided with transversely extending welding bars. The backing jaws of the welding bars are desirably disposed on the means for applying the inner lock.

For easy withdrawal of the pulled-open base with inner lock out of the station where the base is pulled open, gripper units for clamping the side edges of the base may be movable into parallel gaps of a table plate. After withdrawing the base by one length of sack, to enable a correspondingly long section to be severed from the tubular web, a severing knife is provided beneath the table plates for movement over the zone of the gap.

One example of the invention will now be described in more detail with reference to the drawing, wherein.

Figure 1:
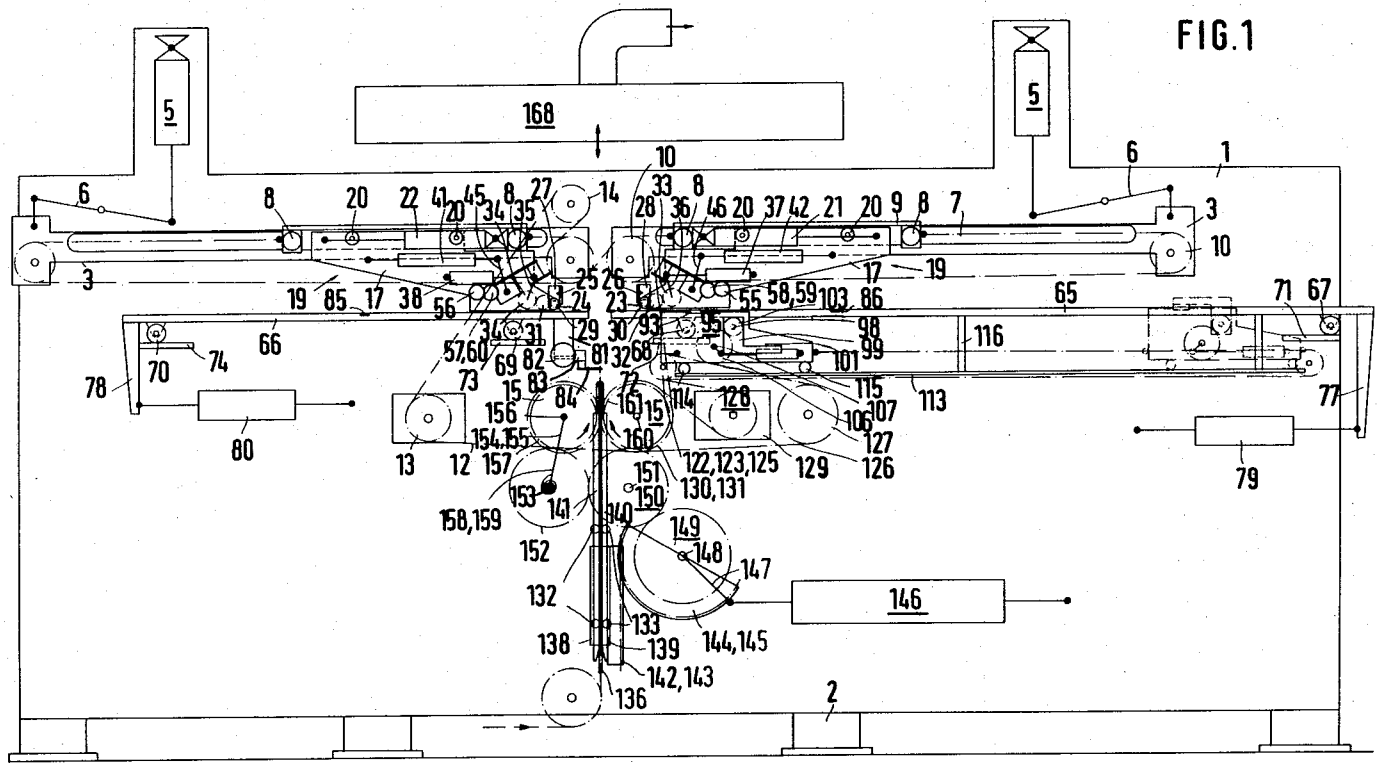
FIG. 1 is a diagrammatic side elevation of the apparatus for pulling bases open.

The machine frame consists substantially of fixed frame members 1 interconnected by cross-members 2. Four guide members 3 are rotatably mounted in these fixed frame members 1, namely for pivoting only about shafts 4 disposed in the vicinity of the confronting parts of the guide members. The pivotal motion of the guide members 3 takes place by way of two hydraulic piston cylinder units 5 which, for the sake of simplicity, are shown in FIG. 1 when turned through 90° and which, by way of an intermediate rod 6, engage the guide members 3 in their end zones directed away from each other. In the position shown in FIG. 1, the guide members are in their raised unpivoted position. As will also be evident from the drawings, all four guide members 3 have longitudinal milled recesses 7 in which rollers 8 are movable. These rollers 8 carry two carriages 9 which can be moved towards and away from each other. For the purpose of moving the two carriages 9, each carriage is associated with four sprockets 10 which are rotatable in the guide members 3.

Every two sprockets 10 secured to one of the four guide members 3 are enveloped by a chain of which the ends are secured to the carriage 9. Two immediately adjacent sprockets 10 comprise a shaft 4 which extends outwardly through the fixed frame 1 and each have a driving sprocket 11 at their outer ends. These driving sprockets 11 are likewise enveloped by a common chain 12 which can be driven by a motor 13. As shown in FIG. 1, the chain 12 runs over a direction-changing sprocket 14 and over a sprocket of one of the two web feed rollers 15.

Figure 2:
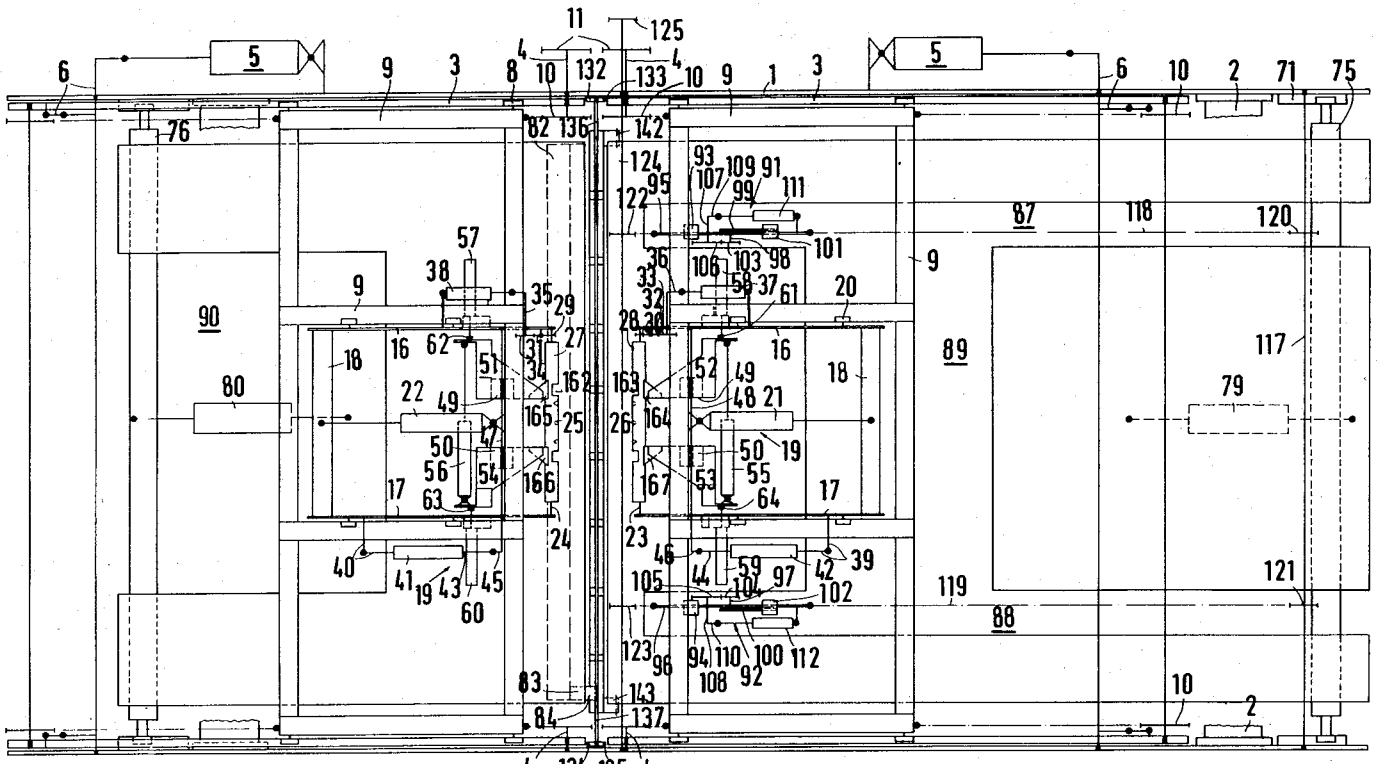
FIG. 2 is a plan view of the FIG. 1 apparatus.

It will be seen from FIG. 2 that each of the two carriages 9 carries a movable operating unit 19 comprising two frames 16 and 17 as well as a cross-member 18. This operating unit 19 is movable on the carriage 9 by way of rollers 20. For this purpose, each operating unit 19 is associated with a hydraulic piston-cylinder unit 21, 22 having its cylinder secured to the carriage 9 and its piston rod to the movable operating unit 19. At the end of the operating unit 19 opposite to the cross-member 18, the two frame members 16 and 17 of each operating unit are connected by a respective shaft 23 and 24. The shafts carry a respective rotatable profile 27 and 28 provided with suction orifices 25 and 26, respectively. For the purpose of turning the profiles 27 and 28 and thus the suction orifices 25 and 26, each of the shafts 23 and 24 carries a respective gear 29 and 30, the gears being connected to drive gears 33 and 34 by way of intermediate gears 31 and 32. The drive gears 33 and 23 can be turned by way of a respective intermediate lever 35, 36 by way of hydraulic piston-cylinder units 37 and 38. The cylinders of these piston-cylinder units 37 and 38 are respectively connected to the frame members 16 of the movable operating unit 19.

The frame members 17 disposed opposite to the frame members 16 carry two further piston-cylinder units 41 and 42 by way of additional rods 39 and 40, respectively. The piston rods 43 and 44 of these hydraulic piston-cylinder units engage a respective intermediate lever 45 and 46, the latter being connected to a respective shaft 47, 48 mounted in the frame members 16 and 17. These shafts 47 and 48 have axial grooves (not shown) extending over their entire length. Two ball housings 49 and 50 are guided in each groove of these shafts 47 and 48, flaps 51, 52, 53, 54 being fixed to the ball housings 49 and 50. Every two flaps, namely 51, 54 and 52, 53 are displaceable relatively to each other by way of hydraulic piston-cylinder units 55 and 56. For the purpose of common alignment of the flaps 51 and 54 on the shaft 47 as well as the two flaps 52 and 53 on the shaft 48, there are four hydraulic piston-cylinder units 57, 58, 59 and 60 carrying tappets 61, 62, 63 and 64 on their piston rods, the tappets lying loosely against flanged portions of the flaps 51 to 54.

As shown in more detail in FIG. 1, two work tables 65 and 66 below the operating units 19 are movable on guides 71, 72, 73 and 74 by way of wheels 67, 68, 69 and 70. These guides are fixed to the fixed frame members 1. As is shown in FIG. 2, the wheels 67 to 70 are connected to the tables 65 and 66 by way of cross-members 75 and 76. A downwardly extending arm 77 is fixed to the table 65 and a downwardly extending arm 78 to the table 66. Hydraulic piston-cylinder units 79 and 80 respectively engaging the two arms 77 and 78 are connected to the frame members 1. The tables 65 and 66 can be moved towards and away from each other by way of these hydraulic piston-cylinder units. At the end facing the table 65, the table 66 carries several consoles 81 which carry a cylinder 82 extending transversely across the entire table surface. This cylinder has a throughgoing longitudinal slot in which a holder 83 can be reciprocated over the entire table surface. The holder 83 carries a knife blade 84. FIG. 1 also shows that transversely extending welding bars 85 and 86 are provided in each of the tables 65, 66.

As will also be evident from FIG. 2, the surface of the table 65 has two longitudinal incisions 87 and 88 and a transverse aperture 89 which interconnects the two longitudinal incisions. The surface of the table 66 merely has a cut-out 90. Below the table 65 near the incisions 87 and 88 of the table 65 there are two movable clamping means 91 and 92 of which the counterbearings 93 and 94 lie in the same plane as the surface of the table 65. Each counterbearing is secured on one of the frame members 95, 96.

A shaft 97 or 98 disposed in these frame members carries a pivotable lever 99, 100 respectively, at the ends of which there is a pivotable flap 101 or 102. These flaps 101, 102 can be swung onto the counterbearings 93, 94 by way of gears 103, 104 keyed onto the shafts 97, 98 and by way of further gears 105, 106 engaging with these gears. For this purpose, a respective hydraulic piston-cylinder unit 111, 112 engages the gears 105, 106 by way of levers 109, 110, the other ends of these units being hinged to the respective frames 95, 96.

The clamping means 91 and 92 are movable on rails 113 by way of wheels 114, 115. For ease of illustration, the guide 113 and the wheels 114 and 115 of the clamping means 92 are only shown in FIG. 1. As will be evident from this Figure, the guides, of which only the guide 113 is illustrated, are secured to the underside of the table 65 by way of the holder 116. Movement of the clamping units 91 and 92 takes place by way of two chains 118 and 119 of which the ends are connected to a respective one clamping means 91 or 92. The chain 118 envelops a sprocket 120 and the chain 119 a sprocket 121. Both sprockets are fixed on a throughgoing shaft 117 mounted in the frame members 1. The chain 118 is also slung about a sprocket 122 and the chain 119 about the sprocket 123. These two sprockets 122 and 123 are likewise secured on a throughgoing shaft 124 rotatably mounted in the fixed frame members 1. One end of the shaft 124 projects out of the fixed frame member 1 and the projection carries a sprocket 125. An endless chain 126 envelops this sprocket 125 and, adjacent thereto, a direction-changing sprocket 127, the pinion 128 of a motor 129, and a sprocket 130 placed on the right-hand web feed roller 15 as viewed in FIG. 1. This sprocket 130 is so placed on the feed roller 15 by way of a free-wheeling device that the sprocket 130 can turn the feed roller 15 only clockwise. Upon counter-clockwise movement of the sprocket, the free-wheeling device becomes operative and the feed roller 15 will not turn.

In the same way as the sprocket 130, the sprocket 130 which is also placed on the feed roller 15 is connected to the feed roller 15 by way of a free-wheeling device so that the motor 13 can only drive the feed roller 15 clockwise by way of the chain 12. It should also be mentioned that the two free-wheeling devices associated with the two sprockets 130 and 131 are each provided with an electromagnetic brake so that the feed roller 15 and the masses moved thereby are immediately halted when the motors 13 and 129 are stopped.

FIG. 2 shows that two pairs of rollers 132, 133 and 134, 135 are rotatably mounted in each fixed frame member 1 beneath the gap formed by the two tables 65 and 66 in the FIG. 1 position. The roller pairs 132 and 133 receive a guide bar 136 and the roller pairs 134, 136 a guide bar 137. A respective supporting rail 138 and 139 are placed on these guide bars from both sides and are so interconnected that they almost clamp the guide bars 136 and 137 between each other. A plurality of spaced upwardly converging fingers 140, 141 are placed on the supporting rails 138 and 139. For the purpose of to and fro movement of the fingers 141 and 140, two racks 142 and 143 are welded to the two ends of the supporting rail 139. Gear segments 144 and 145 engage with the teeth of these racks. Both gear segments 144 and 145 are placed on a throughgoing common shaft mounted in the fixed frame members 1. Secured to this common shaft 148 there is a lever 147 which can be turned by way of a hydraulic piston-cylinder unit 146. This turns the segments 144 and 145 by the same amount.

With the interposition of a free-wheeling device, a gear 149 is also placed on the shaft 148 adjacent to the gear segments 144 and 145. The free-wheeling device is constructed so that it stops clockwise rotation of the shaft 148.

The gear 149 is in mesh with an intermediate gear 150 which is rotatably seated on a pin 151 fixed in one of the two fixed frame members 1. The intermediate gear 150 is engaged with a further intermediate gear 152. This intermediate gear 152 is freely rotatable on a throughgoing shaft 153 which is rotatably mounted in the two fixed frame members. Two levers 154 and 155 placed on the shaft 153 carry a shaft 156 at their free ends. This shaft 156 receives one of the two feed rollers 15 as well as a gear 157 which, in turn, engages the gear 152. The levers 154 and 155 are turned clockwise by torsion springs 158 and 159 placed on the shaft 153. Pivoting of the feed roller shown at the left-hand side of FIG. 1 is, however, limited in that it comes to lie against the right-hand feed roller in that figure that is rotatably mounted on a shaft 160 which is mounted in the two fixed frame members 1. Adjacent to the feed roller 15 and the two sprockets 130 and 131, the shaft 160 also carries a gear 161 which is keyed to the shaft 160 and engages the intermediate gear 150.

The operation of the apparatus according to the invention will now be described.

In the position shown in FIGS. 1 and 2, the apparatus for pulling a base open is disposed in the starting position, i.e. the web B is disposed between the fingers 140 and 141 and projects therebeyond to an extent determined by the spacing between the upper ends of the fingers and the knife 84. The knife or knife blade 84 is located in the non-engaging position clear from FIG. 2. On starting the apparatus, the hydraulic piston-cylinder unit 146 is activated whereby the segments 144 and 145 are pivoted. Pivoting of the segments causes the fingers to move upwardly beyond the gap formed by the two tables 65 and 66.

Since the gear 149 is turned at the same time as the segments 144 and 145, the feed rollers 15 are driven in the feeding direction by way of the intermediate gears 150 and 152 so that, together with the fingers 140 and 141, the web B of film is moved upwardly, namely through a distance which is smaller than that of the fingers by an amount corresponding to the distance between the knife blade 84 and the upper limit of the fingers. This is achieved in that the diameter of the segments 144 and 145 is larger than the diameter of the gear 149 by which the feed rollers 15 are driven. The diameter differences and thus the speed differences between the web and fingers are designed so that, in the upper position of the fingers 140 and 141, the web B is flush with the upper limit of the fingers.

After this has occurred, the two operating units 19 are moved together to such an extent by way of the hydraulic piston-cylinder units 21 and 22 that the suction orifices 25 and 26 of the profiles 27 and 28 lie against the web which projects upwardly beyond the table surface 65 and 66. To enable this to occur, the profiles 27 and 28 have, as is shown in FIG. 2, recesses 162 and 163 which serve to receive the fingers 140 and 141. As soon as the film has been clamped by the profiles 27 and 28, the suction air for the orifices 25 and 26 is switched on. The web B is now so held by the suction orifices 25 and 26 that the fingers 140 and 141 can be returned downwardly to their starting position. After this has occurred, the profiles 27 and 28 are swung away from the table gap through 90°. During this pivoting movement, it is necessary to advance the web material slightly by further actuation of the cylinder 146 so that this pivoting movement of the profiles can in any case take place without pulling the web from the orifices 25 and 26. By means of the hydraulic piston-cylinder units 79 and 80, the tables 65 and 66 then move towards each other out of the FIG. 1 position to leave a spacing which only permits the web B to pass. To assist the holding force of the suction orifices 25 and 26, the flaps 51, 52, 53 and 54 are then firmly placed on the turned-over profiles 27 and 28 so that the web of film is clamped between the aligning triangles 164 to 167 and the profiles 27 and 28.

For the purpose of forming the base, the two carriages 9 then move apart so that the tube can be pulled open and the base formed because the profiles 27 and 28 are moved apart at the same time as the carriages 9. After the carriages 9 have reached their end position, the two tables 65 and 66 are moved together so that the tubular web of film is clamped between the two tables. As this takes place, the flaps 51 to 54 are slightly relaxed and at the same time the tappets 61, 62, 63 and 64 are moved back. The piston-cylinder units 21 and 22 then move back at a reduced pressure until the aligning triangles 164 to 167, about which the tubular film has been laid during formation of the base, have so pulled open and aligned the base that all four sides of the pulled-open tube are uniformly tensioned.

Depending on the tolerances which may be up to 3 cm in the width of the tube, the flaps 51 to 54 are then axially displaced on the associated shafts 47 and 48 during their return movement together with the aligning triangles 164 to 167 secured thereto, i.e. the triangles for aligning the sack can, as they are moving away from the table gap, freely swing sideways and thereby compensate for tolerances. It will be evident that the axial spacing between every two flaps 51 and 54 or 52 and 53 were previously set to the desired size by the appropriate piston-cylinder units 55 and 56.

The formation of a base is thus concluded and the inner lock can be applied to the open base and welded thereto by the inner lock applicator 168 which is diagrammatically illustrated in FIG. 1. However, before this takes place it is necessary to lower the profiles 26 and 27 to such an extent that the surfaces having the suction orifices 25 and 26 are disposed in the plane of the tables 65 and 66 so that the inner lock can indeed be placed flat on the pulled-open base in one plane. For this purpose the carriages 9 are lowered by the piston-cylinder units 5 about the confronting shafts of the sprockets 10 through the openings 89 and 90 of the tables 65 and 66.

Figure 3:
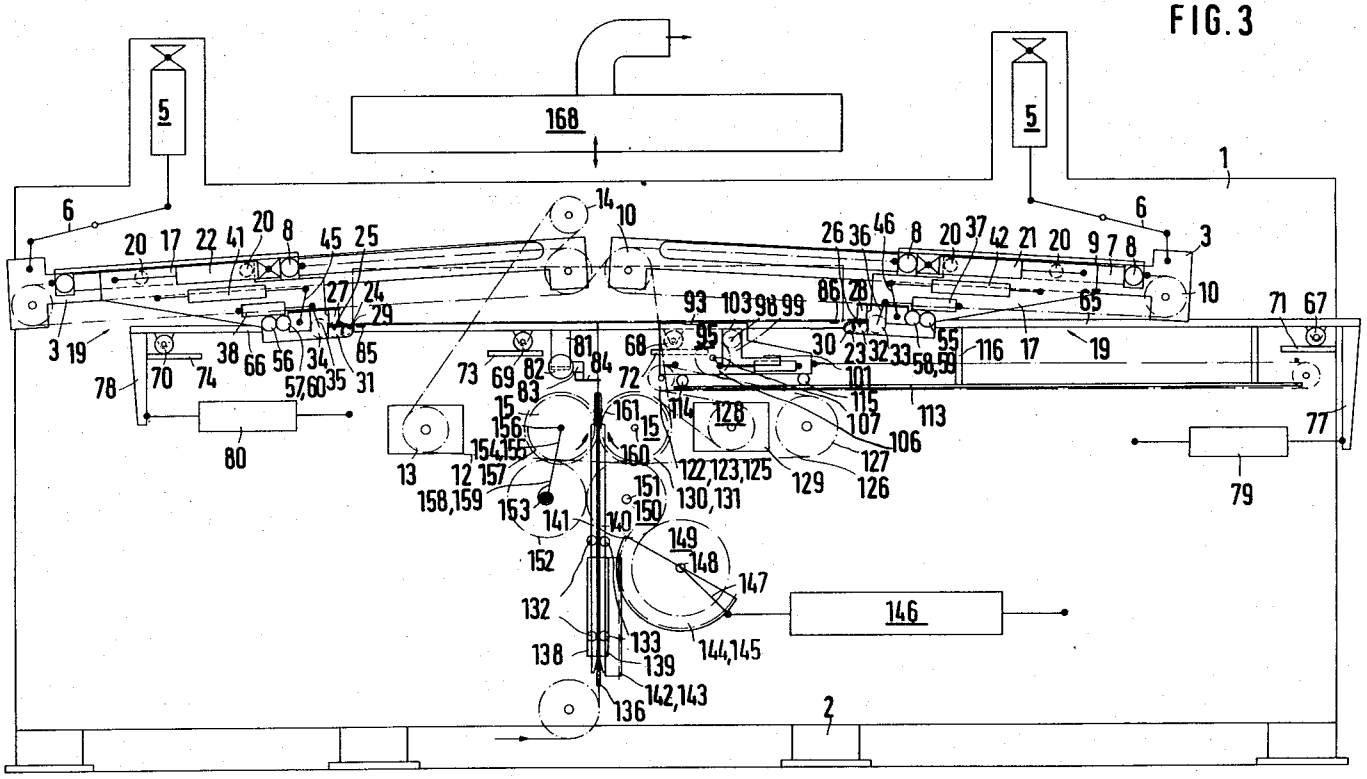
FIG. 3 shows the FIG. 1 apparatus after a base has been pulled open with the gripping and pulling means lowered and FIG. 4 is a plan view of the FIG. 3 apparatus.
Figure 4:
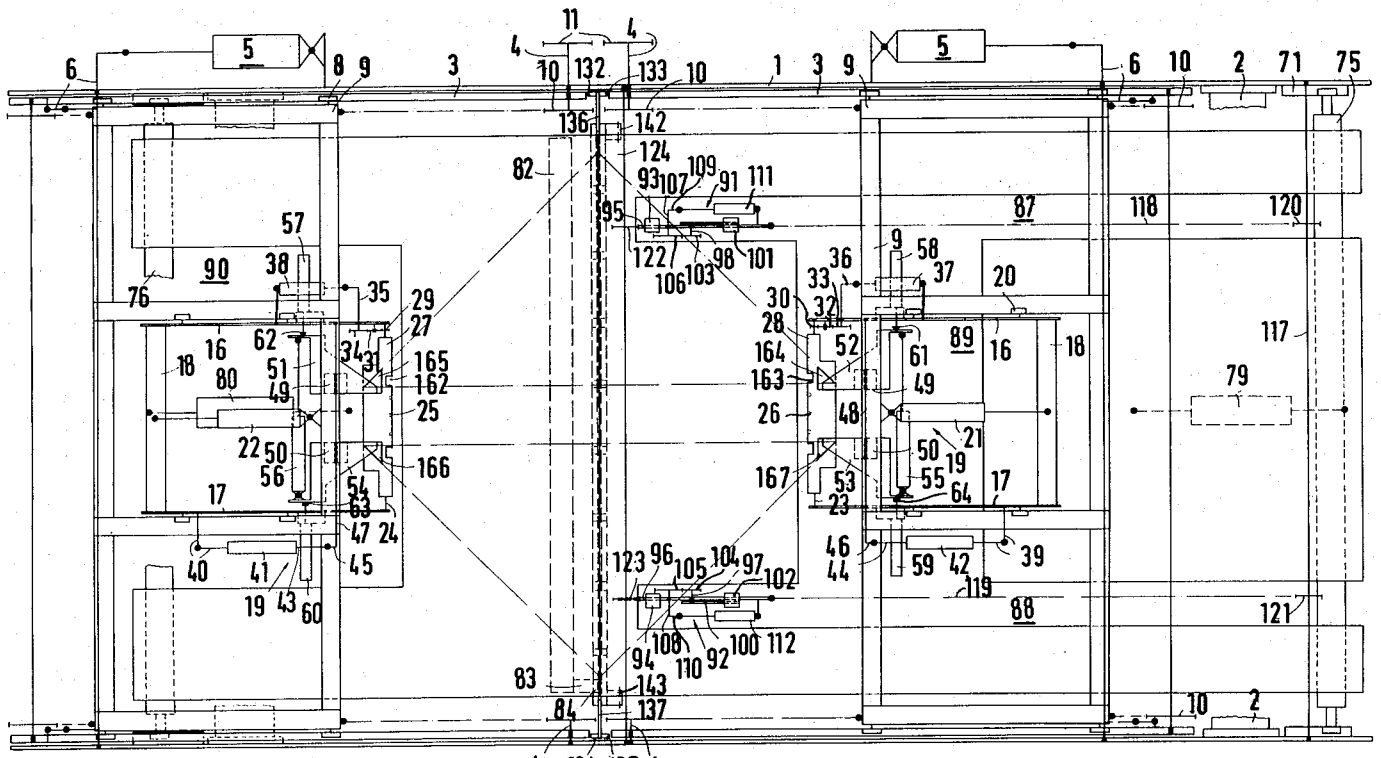

FIGS. 3 and 4 show the apparatus in a position in which an inner lock 169 has just been applied by the inner lock application station 168 and in which, as is evident from FIG. 3, the carriages 9 and thus the profiles 27 and 28 with the suction orifices 25 and 26 are still located in the lowered position.

The inner lock applicator station is not shown in FIGS. 3 and 4 and will not be described in more detail. The suction air for the profiles 27 and 28 can then be switched off. Subsequently, the aligning triangles 164 to 167 must be moved out of the base. For this purpose, the flaps 51 and 54 are moved towards the flaps 52 and 53, in the former case by way of the hydraulic piston-cylinder unit 56 and in the latter case by way of the hydraulic piston-cylinder unit 55.

To achieve central alignment of the two flaps while they are moved together, the pistons of the cylinder units 57, 58, 59 and 60 are moved out by exactly the same amount. This prevents, for example when the flaps 52 and 50 or 51 and 54 are moved towards each other, only the aligning triangles 166 and 167 from moving out of the base whilst the aligning triangles 164 and 165 remain in the base. Since during this movement phase the hydraulic piston-cylinder units 21 and 22 are still constantly under a low pressure, both operating units 19 return to their starting position directly after withdrawal of the aligning triangles. In this position, the flaps 51 to 54 are swung back to the starting position by way of the hydraulic piston-cylinder units 41 and 42 and by way of the grooved shafts 47 and 48.

Together with swinging back of the flaps 51 to 54, the profiles 27 and 28 are also returned to their starting position by way of the hydraulic piston-cylinder units 37 and 38. By means of the two cylinders 5, the two carriages 9 are then brought out of their inclined FIG. 3 position to their horizontal FIG. 1 position.

During lifting of the two carriages 9, the flap 51 to 54 are also moved back to their starting position by way of the piston-cylinder units 57 to 60 and 55 and 56. Thereafter, both operating units 19 are moved towards each other by the carriages 9 and then assume the position of readiness shown in FIGS. 1 to 2. As shown in FIG. 4, the counterbearings 93 and 94 are disposed in the side zone of the pulled-open base, namely below same. By way of the piston-cylinder units 111 and 112, the flaps 101 and 102 are then swung onto the counterbearings 93 and 94 and clamp the base between each other. Thereafter, the two tables 65 and 66 move apart slightly by way of the cylinders 79 and 80 so that the clamping action of the web B between the tables is released.

Subsequently, the two clamping means 91 and 92 are moved to the right by way of the chains 118 and 119. The chains are driven by the motor 129 which, simultaneously with driving the chains 118 and 119, drives the feed rollers 15 so that, during movement of the clamping means 91 and 92, tubular web material is simultaneously advanced by the feed rollers 15. The clamping means 91 and 92 are well as the feed rollers 15 are actuated until the desired length of section has been achieved. (The outer position of the clamping means 91 and 92 is shown in broken lines in FIG. 1.)

Subsequently, the tables 65 and 66 are moved together again by way of the piston-cylinder units 79 and 80 and they clamp the web between each other so that, by actuating the cylinder 82, the web can then be severed by the knife blade 84. When the clamping means 91 and 92 have achieved the end position shown in broken lines, the flaps 101 and 102 are swung back and the finished sack section is taken away by transporting means (not shown).

The motor 129 is then switched over and, by way of the chains 118 and 119, pulls the clamping means back to the FIG. 1 position. In order that the feed rollers 15 are not turned back during this operating phase of the motor, the free-wheeling device associated with the associated sprocket becomes operative.

The procedure hereinbefore described for forming the base and applying an inner lock can be repeated in a similar manner after the two tables 65 and 66 have first again reached their FIG. 1 position by means of the cylinders 79 and 80.

It might be mentioned that obviously also during movement of the carriages 9 apart when pulling a base open, the feed rollers 15 are likewise driven by the motor 13 and during return movement of the carriages 9 the appropriate free-wheeling device of the feed roller 15 becomes operative so that the feed rollers 15 cannot be turned back. The latter consist of a plurality of spaced rollers so that each of the fingers 140, 141 is disposed between two rollers.

We claim:

1. Apparatus for pulling tube ends open to form base squares in the production of large cross-bottom sacks, comprising table plates which are disposed in the machine frame parallel to the plane of the pulled-open bases and which are separated from one another by a gap through which the tubular web is feedable by feeding means in a plane substantially perpendicular to the table plates, and suckers disposed at both sides of the edges of the tubular web end for pulling the edges apart, characterised in that the suckers (25–28) are secured to carriages (9) which are movable in parallel guides (3, 7) of the frame (1) and which can be moved by drive means (4, 10, 11, 12, 13) from their position in which they are pushed together to the pulled-open position of the base.

2. Apparatus according to claim 1, characterised in that the suckers (25–28) consist of suction bars rotatable through 90° about shafts (23, 24) parallel to the table plates (65, 66).

3. Apparatus according to claim 1, characterised in that flaps (51–54) are provided in the carriages (9) on shafts (47, 48) parallel to the gap, which flaps can be swung into the opened-up tube ends and carry at their free ends spreader plates (164–167) which form pulling-out triangles and of which the outer edges include an angle of 90°.

4. Apparatus according to claim 3, characterised in that the flaps (51–54) are movable by drive means (55, 56) towards and away from one another parallel to the gap.

5. Apparatus according to claim 3, characterised in that each pair of flaps (51, 54; 52, 53) is mounted as a unit displaceable transverse to the pulling-out direction.

6. Apparatus according to claim 5, characterised in that piston-cylinder units (57, 60; 58, 59) are provided for displacing the flaps (51, 54; 52, 53) transversely.

7. Apparatus according to claim 3, characterised in that the operating units (19) consisting of the suction bars (27, 28) and pivotable flaps (51, 54; 52, 53) are mounted by way of rollers (20) for movement into the carriage (9) in the pulling-out direction and are provided with drive means (21, 22) moving same relatively to the carriage (9).

8. Apparatus according to claim 3, characterised in that the suction bars (27, 28) form counterbearings for the spreader plates (164–167) for clamping the tube edges.

9. Apparatus according to claim 1, characterised in that the table plates (65, 66) are supported in their plane on guides (71–74) by way of rollers (68–70) and can be moved together and apart by drive means (79, 80) to clamp the tubular web.

10. Apparatus according to claim 1, characterised in that the guides (3, 7) of the carriages (9) are pivotably mounted by drive means (5, 6) about shafts (4) parallel to the gap so that, in the pulled-out condition (FIGS. 3, 4), the suction bars (25, 26) can be lowered with the spreader plates (164–167) down to the plane of the table plates (65, 66) which are provided with complementary recesses (89, 90).

11. Apparatus according to claim 1, characterised in that the table plates are provided with transversely extending welding bars (85, 86).

12. Apparatus according to claim 11, characterised in that the backing jaws of the welding bars are disposed in the means (168) for applying the inner lock.

13. Apparatus according to claim 1, characterised in that raisable and lowerable fingers (140, 141) are provided in the plane of the gap for feeding the web (B) to the suckers (25–28).

14. Apparatus according to claim 13, characterised in that the suction bars (27, 28) are provided with recesses (162, 163) for the fingers (140, 141).

15. Apparatus according to claim 1, characterised in that, for withdrawing the pulled-open bases provided with base locks, gripper units (91, 92) for clamping the side edges of the base can be moved into parallel gaps (87, 88) of a table plate (65).

16. Apparatus according to claim 1, characterised in that, for severing from the web (B) a tube section provided with a pulled-open base, a severing knife (84) is provided beneath the table plates (65, 66) for movement over the zone of the gap.

* * * * *